United States Patent [19]

Barman

[11] Patent Number: 4,876,157

[45] Date of Patent: Oct. 24, 1989

[54] PROCESS FOR PRODUCING A TOOTHBRUSH AND A TOOTHBRUSH BLANK FOR USE IN THE PROCESS

[76] Inventor: Rolf Barman, Olav Kyrresgt.45, N-5000 Bergen, Norway

[21] Appl. No.: 153,821

[22] PCT Filed: May 30, 1986

[86] PCT No.: PCT/NO86/00037

§ 371 Date: Jan. 25, 1988

§ 102(e) Date: Jan. 25, 1988

[87] PCT Pub. No.: WO87/07123

PCT Pub. Date: Dec. 3, 1987

[51] Int. Cl.[4] ..... B29B 7/00; A46B 9/04

[52] U.S. Cl. ..... 428/542.8; 15/167.2; 300/21

[58] Field of Search ..... 15/167.1, 167.2; 300/4, 300/17, 21; 428/85, 89, 358, 542.8

[56] References Cited

U.S. PATENT DOCUMENTS

| | | | |
|---|---|---|---|
| 2,771,624 | 11/1956 | Ripper | 15/167.2 |
| 2,807,820 | 10/1957 | Dinhdfer | 15/176.1 |
| 4,131,967 | 1/1979 | Northemann et al. | 15/167.2 |
| 4,449,266 | 5/1984 | Northemann et al. | 15/167.2 |

FOREIGN PATENT DOCUMENTS

| | | | |
|---|---|---|---|
| 855253 | 5/1940 | France | 15/167.2 |
| 1230365 | 3/1960 | France | 15/167.2 |
| 350456 | 7/1937 | Italy | 15/167.2 |

*Primary Examiner*—Peter Feldman
*Attorney, Agent, or Firm*—Kenyon & Kenyon

[57] ABSTRACT

A toothbrush blank having a handle, a pair of head portions provided with a plurality of bristles receiving bores on one side of the head portions, and a narrow hinge-forming V-shaped cavity or groove formed on the same bristle receiving side of the head portions. The V-shaped groove enables the head portions to be bent in a convex arch so that the bristles can be cut and polished in a common plane. Thereafter the head portions are bent toward each other into a finished condition where the side surfaces of the V-shaped groove form support abutments which are glued or welded against each other.

6 Claims, 3 Drawing Sheets

PROCESS FOR PRODUCING A TOOTHBRUSH AND A TOOTHBRUSH BLANK FOR USE IN THE PROCESS

The present invention relates to a process for producing a toothbrush having a toothbrush head which is provided with two bristle-supporting head portions.

Tooth brushes are known which have a first and a second bristle-supporting head portion, which permit two or more surfaces (outside, inside and masticating surfaces) on a tooth in a series of teeth to be simultaneously brushed. From French patent specification No. 1,230,365 it is known to allow the bristle end planes to form an angle of between 40° and 80°. In Austrian patent specification No. 352,260 bristle end planes are proposed and illustrated which form an angle substantially below 40°. In U.S. Pat. No. 4,115,894 several different designs of toothbrush heads are proposed with different angles for the head portions and with different angles for the bristle end planes. In order to achieve the best possible effect of brushing teeth with two obliquely impacting groups of bristles provision has been made for the bristles in each group to have the shortest bristle innermost and the longest bristle outermost, reckoned from the point of the bristle end planes impacting in V form. However such a bristle design involves significant manufacturing problems, since it has been difficult with simple means and in a simple way to cut and polish the bristle end plane of the two head portions simultaneously. As a consquence of these manufacturing problems toothbrushes of the afore-mentioned kind, even if they exhibit significantly useful advantages, have not been competitive from a price point of view relative to conventional toothbrushes having a simple toothbrush head.

According to U.S. Pat. No. 4,449,266 it has been proposed to install the bristles in the two head portions, while these are present in a flush position to each other, after which the bristles—while the head portions still occupy the same mutually flush position—are cut and polished and the head portions are finally bent into a finished position. The problem with such a mode of manufacture is that the bristle end planes are cut and polished at an angle relative to each other. Both the cutting equipment and the polishing equipment must necessarily be of complicated design if one is to be able to effect the cutting operation and the polishing operation in an accurate manner. Special problems involve the polishing device being mainly able to rotate in a specific position without substantial sideways movement, as is otherwise customary in the polishing of the bristle end surface of a toothbrush. The toothbrush materials must thereby be worked singly to a large extent.

With the present invention the aim is to avoid the afore-mentioned problems, conventional cutting equipment and polishing equipment being able to be employed according to the invention and this equipment being able to be moved in a conventional manner in one and the same plane along the bristle end planes. In this way there is the possibility of simultaneously finishing a large group of toothbrush materials with associated bristles in a common cutting operation and thereafter in a common polishing operation, in a conventional manner.

The process according to the invention is characterised in that the bristles, after they are installed in their respective head portions approximately at right angles (80°–100°) to the main plane of the head portion, are cut and polished at the ends jointly in a position where the head portions form a convex arc or where the main planes of the head portions form an angle d greater than 180° with each other, after which the head portions are bent into a concavely curved contour or into a position where the main planes of the head portions extend at an angle a to each other.

By providing according to the invention a convex arc or a "negative" bending angle for the head portion, while cutting and polishing is effected, there is the possibility of utilising conventional equipment for mass production in a simple and uncomplicated manner, so that there is achieved a precisely defined cutting and polishing having a high degree of quality on the two groups of bristles of the toothbrush material, which thereafter are bent towards each other into a finished condition.

In order to ensure an accurate establishment of the intended angle between the bristle end planes the bending operation can be controlled to finished position with the aid of simple means. In this connection it is preferred that the process according to the invention is characterised by using a toothbrush material which, at any rate at the toothbrush head and if desired over the whole length of the toothbrush material, is provided with one or more mutually parallel, hinge-forming attenuation line(s), formed by V-shaped grooves, the side surfaces of the V-shaped groove after bending into the position of finished design form support abutments against each other and the side surfaces in the position of finished design being glued or welded into permanent connection with each other.

The invention also relates to a toothbrush produced by the process according to the invention, where the head of the toothbrush is provided with mutually angled head portions having rows of bristle groups directed obliquely towards each other.

The toothbrush is characterised in that outer edges of the toothbrush head converge in a direction forwards towards the longitudinal central plane of the toothbrush, and that the groups of bristles are arranged in equivalent forwardly converging rows.

A toothbrush is preferred, where the groups of bristles at the inner front edge portion of the toothbrush head are significantly shorter than the groups of bristles at the outer rear edge portion of the toothbrush head.

The toothbrush is characterised in that a smaller number of groups of bristles are arranged at the front edge of each of the head portions of the toothbrush head than at the rear edge of said head portions, and that between inner edges of the head portions facing towards each other there is cut out a forwardly opening V-shaped groove, while correspondingly between inner rows of groups of bristles of the head portions there is fashioned a similar forwardly opening V-shaped groove at outer portions of the bristles, at least between the groups of bristles at front inner edges of the head portions.

Further features of the invention will be evident from the following description having regard to the accompanying drawings, in which.

Figure 1:
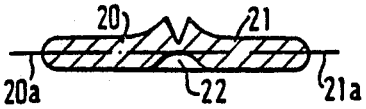
FIGS. 1–3 show in section a preliminary operation known per se for installing bristles in two head portions of a toothbrush blank.
Figure 9:
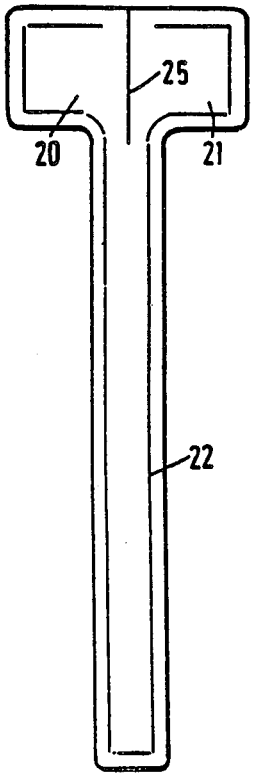
FIG. 9 shows a toothbrush blank according to the invention illustrated from the back side.

In FIGS. 1 and 9 there are shown two head portions 20 and 21 which are supported by a common handle 22 (FIG. 9), and which together constitute a toothbrush blank. The head portions 20 and 21 have the main planes as indicated by chain lines 20*a* and 21*a* extending in alignment with each other, that is to say they form an intermediate angle of 180° with each other.

Figure 2:
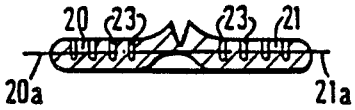
Figure 3:
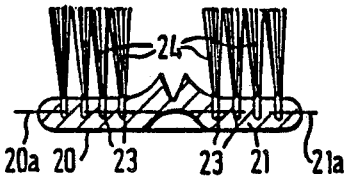

In FIG. 2 the head portions 20 and 21 are shown after they have been fashioned with a series of bores or with precast holes 23, and in FIG. 3 there are shown fastened-in groups of bristles 24 received in the bores or the holes 23 in the head portions 20 and 21.

Figure 4:
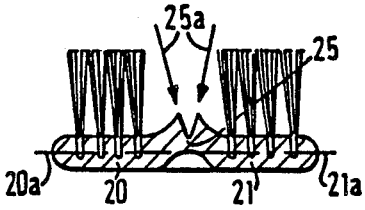
FIGS. 4 and 5 show the step of heating and a first bending with a "negative" angle.

In FIG. 4 the head part of the toothbrush blank is subjected to heating shown by arrows 25*a* locally along an attentuation line 25 (FIG. 9) as indicated by a first obtuse, U-shaped cavity on the under side and a certain, V-shaped cavity on the upper side of the transition portion between the head portions 20 and 21.

Figure 5:
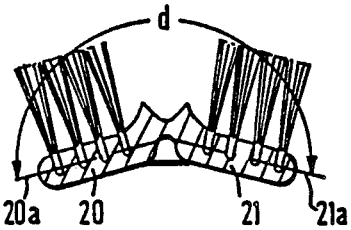
Figure 6:
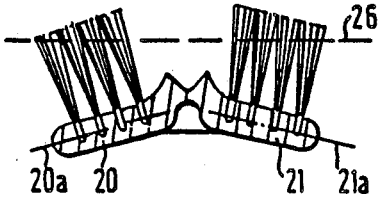
FIGS. 6 and 7 show respectively the cutting operation and the polishing operation with the head portions bent in a "negative" angle.
Figure 7:
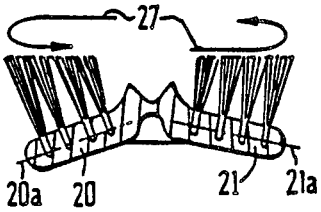
Figure 8:
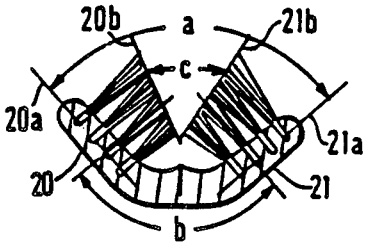
FIG. 8 shows the head portions with associated bristles in a finished condition.

In FIG. 5 the main plane 20*a* and 21*a* of the head portions are bent to an intermediate "negative" angle d of 210°. In FIG. 6 a cutting operation is shown illustrated by a broken straight line 26 which shows that all the bristles are cut with a common cut in one and the same plane. Correspondingly there is shown schematically in FIG. 7 a polishing operation illustrated by arrows 27, the polishing equipment being able to be moved in a pattern of movement parallel to the line 26 on FIG. 6. After the polishing operation is effected, a new heating of the hinge-forming transition portion between the head portions 20, 21 is undertaken, after which the head portions 20, 21 are pivoted back an angle $d-a=110°$ and the main planes 20*a* and 21*a* of the head portions assume an intermediate angle a equal to 100°. This angle can be guaranteed in an accurately established manner by allowing the side surfaces along the V-shaped groove of the attentuation line 25 to form a supporting abutment against each other. Finally the head portions 20, 21 are connected in rigid combination with each other in that said side surfaces are glued, welded or jointed together in another manner into a permanent and rigid union with each other. In the position which is shown in FIG. 8 the bristles in the first head portion 20 and the bristles in the second head portion 21 assume an angle $b=a$ relative to each other, that is to say an angle $b=100°$. As a consequence of the cutting to the "negative" angle d as shown in FIG. 5, that is to say an angle $d=210°$, the bristle end planes 20*b* and 21*b* of the bristles of the two head portions 20 and 21 will form an angle c with each other, that is to say an angle $c=75°$.

Instead of effecting the bending from the position of FIG. 4 to the position of FIG. 5 the brush heads can if desired be produced in the position which is illustrated in FIG. 5, the bristles being able to be installed directly into the brush head in the position shown in FIG. 5.

Figure 10:
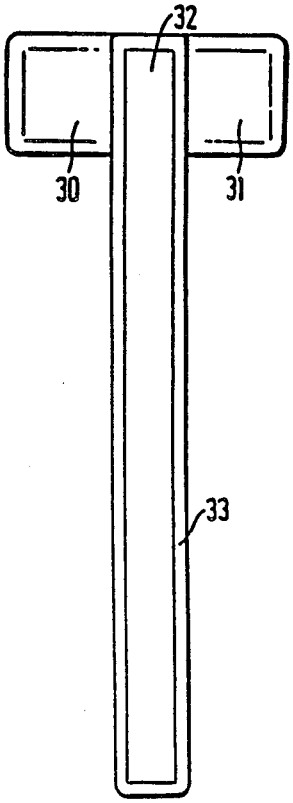
FIG. 10 shows a toothbrush blank according to the invention according to an alternative construction, illustrated from the back side, correspondingly as in FIG. 9.
Figure 19:
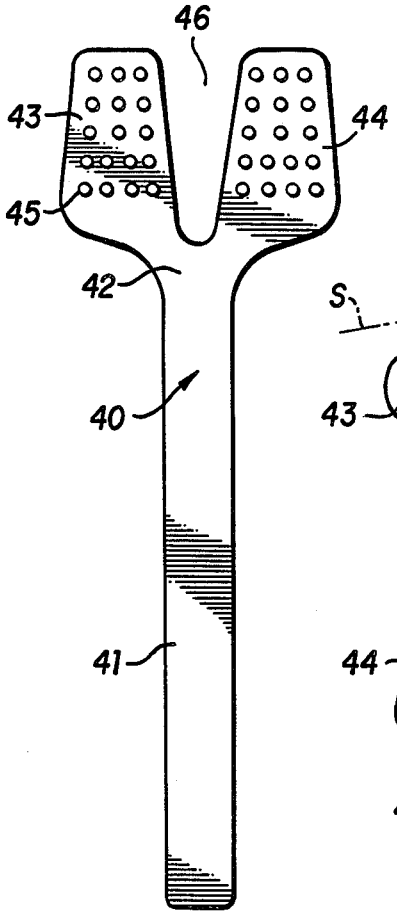
Figure 20:
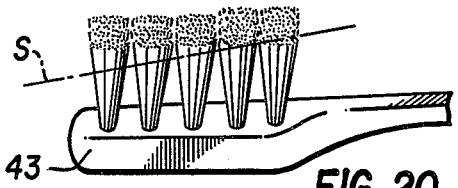
Figure 21:
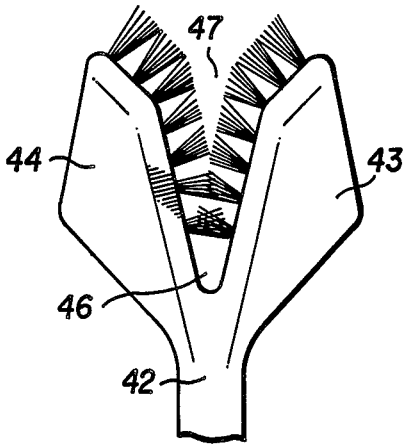

In FIG. 10 there is shown a toothbrush blank 30-33 consisting of a first head portion 30 and a second head portion 31 together with an intermediate head portion 32 which forms a planar extension of the handle 33.

Figure 11:
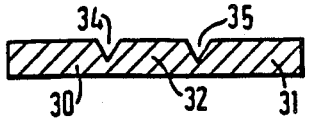
FIGS. 11–18 show in section production steps as shown correspondingly in FIGS. 1–8 and based on a toothbrush blank in accordance with FIG. 10.
Figure 12:
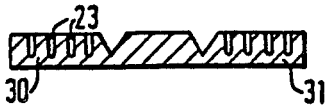
Figure 13:
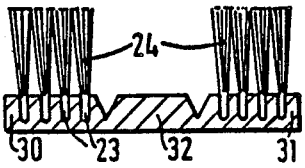
Figure 14:
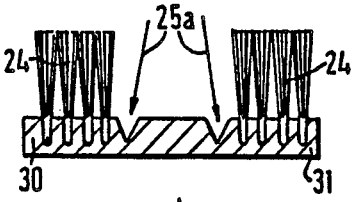
Figure 15:
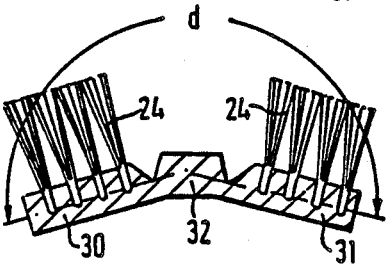
Figure 16:
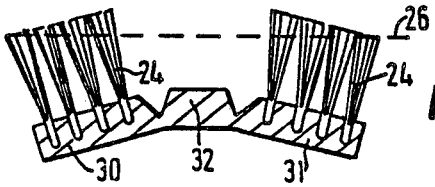
Figure 17:
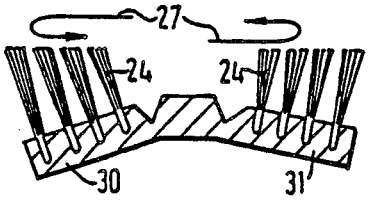
Figure 18:
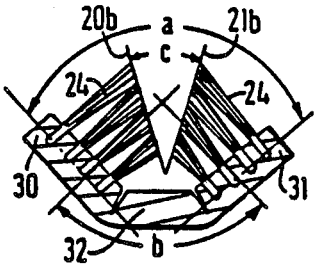

As shown in FIGS. 10 and 11, each of the head portions 30, 31 is connected to the intermediate head portion 32 via narrowed transition portions along attentuation lines 34 and 35 shown in the form of a V-shaped groove on one side of the toothbrush blank. The side surfaces which define said grooves form in a manner corresponding to that shown in FIG. 8 stop-forming support abutments against each other and cooperating joint surfaces between the head portions, such as illustrated in FIG. 18, the production taking place in FIGS. 11–18 in an equivalent manner to that shown and descibed in connection with FIGS. 1–8 according to the first embodiment.

In the illustrated embodiments there are shown head parts which are adapted to be angled with narrow angles relative to each other along one or two hinge-forming attentuation lines. If desired two or three such attentuation lines can be employed. By employing said attentuation lines short heating times can be employed, at the same time as reliable control of the bending operation can be obtained. Alternatively one can effect, instead of narrow angled bends, bending from a convex to a concave arcuate shape, by undertaking heating of the whole of the head parts and fashioning the latter by means of an extra moulding surface or extra moulding means.

By employing the arcuate shape of the head part there is the possibility of fashioning the head portion in an easy manner into different variants as required, that is to say with different shapes of the bristles in one and the same group or with different shapes of the groups of bristles.

While there is shown herein only two head portions with their respective group of bristles three or more head parts can be alternatively employed, each with its respective group of bristles. In the construction which is illustrated in FIGS. 10 and 18 the central main part can for example be provided with a separate group of bristles which can be received between the groups of bristles of the two remaining head parts.

I claim:

1. A toothbrush blank comprising
   - a handle;
   - a pair of head portions integrally mounted on said handle;
   - a narrowed hinge-forming transition portion having a V-shaped cavity on one side between said head portions to permit bending of said head portions into angular relation to each other; and
   - a plurality of rows of bores in said one side for receiving bristles in each head portion.

2. A toothbrush blank as set forth in claim 1 made of heat deformable material whereby said V-shaped cavity of said transition portion permits bending of said head portions into abutting relation during heating thereof.

3. A toothbrush blank comprising
   - a handle
   - a pair of head portions integral with and extending laterally from said handle, each portion having bores on one side for receiving bristles; and
   - a narrowed transition portion between and integral with said head portions, said transition portions defining a first V-shaped cavity on said one side of said head portions and a second cavity on an opposition side, said transition portion being deformable under heat to permit said head portions to be moved into angular relation relative to each other while closing said V-shaped cavity.

4. A toothbrush blank as set forth in claim 3 wherein said first cavity is V-shaped to permit said head portions to move into abutment with each other to close said first cavity upon deformation of said transition portion.

5. A toothbrush blank comprising a handle;

a pair of head portions integral with and extending laterally from said handle, each portion having bores on one side for receiving bristles;

at least a pair of narrowed transition portions, each transition portion being integral with and extending between a respective head portion and said handle, each said transition portion having a V-shaped cavity on said side and being deformable under heat to permit said head portions to be moved into angular relation relative to said handle.

6. A toothbrush blank is set forth in claim 5 wherein said handle and said head portions have rows of bores for receiving bristles.

* * * * *